United States Patent [19]

Giannetti

[11] Patent Number: 4,584,437

[45] Date of Patent: Apr. 22, 1986

[54] HEARING AIDS OF THE TYPE INTENDED TO BE FITTED IN THE EXTERNAL AUDITORY MEATUS OF THE USER

[76] Inventor: Vittorio Giannetti, Via Deruta 63, Roma, Italy

[21] Appl. No.: 461,235

[22] Filed: Jan. 26, 1983

[30] Foreign Application Priority Data

Jan. 27, 1982 [IT] Italy ..... 35564/82[U]
Jan. 27, 1982 [IT] Italy ..... 35568/82[U]
Dec. 30, 1982 [IT] Italy ..... 36258/82[U]

[51] Int. Cl.[4] ..... H04R 25/02
[52] U.S. Cl. ..... 179/107 E; 381/69
[58] Field of Search ..... 179/107 E, 107 R, 178, 179/179; 381/68, 69; 220/327, 322, 328; 248/220.2, 223.3, 224.3

[56] References Cited

U.S. PATENT DOCUMENTS

Re. 26,174 3/1967 Leale ..... 179/107 E
2,882,348 4/1959 Erickson ..... 179/107 H
3,335,898 8/1967 Eisinga ..... 220/327
3,688,053 8/1972 Bosch et al. ..... 179/107 E
3,974,933 8/1976 Toth et al. ..... 220/327
4,069,400 1/1978 Johanson et al. ..... 179/107 E
4,471,490 9/1984 Billafiore ..... 179/107 E
4,476,353 10/1984 Haetrl ..... 179/107 E

FOREIGN PATENT DOCUMENTS 1083966 9/1967 United Kingdom ..... 179/107 H

*Primary Examiner*—Gene Z. Rubinson
*Assistant Examiner*—Danita R. Byrd
*Attorney, Agent, or Firm*—Bacon & Thomas

[57] ABSTRACT

A hearing aid having a closure plate which is removably joined through the use of screws. A battery cover is pivotable into a position where it can be easily gripped by a user's fingers so that it can aid in positioning the aid in the user's ear.

2 Claims, 4 Drawing Figures

HEARING AIDS OF THE TYPE INTENDED TO BE FITTED IN THE EXTERNAL AUDITORY MEATUS OF THE USER

This invention relates to a closure plate and a joining system for the hearing aids of the type intended to be received in the external auditory meatus of the user.

The hearing aids of this type comprise substantially a microphone, an amplifier, a potentiometer and an electroacoustic transducer, all received in a housing or cap of anatomic shape, substantially of frustoconical shape, which cap is adapted to exactly fit the external auditory meatus of the user. Furthermore these hearing aids include a battery that is normally received in a suitable seat formed in a closure plate closing the cap opening at the larger end, or base, of the cap. The plate is normally of a suitable rigid plastic material.

In the hearing aids of the prior art, the closure plate is glued to the opening edge and this system is impractical especially in assembling manufacturing and maintenance and repair of the hearing aid during its life. These operations may involve a number of gluing and detaching operations.

Furthermore, in the hearing aids of the prior art, the battery seat is closed by a cover adapted to rotate between a closed and an open position about an axis perpendicular to the plate, i.e. the cover rotates in a plane that is parallel to the plate.

This construction has the drawback that the closure plate does not present any gripping member for the user's fingers and therefore the introduction of the hearing aid in the external auditory meatus of the user's and particularly the removal therefrom are difficult and troublesome.

Accordingly it is an object of the invention to provide a hearing aid in which the above drawbacks are overcome.

According to a feature of the invention, a horse-shoe shaped bracket is welded or otherwise joined to the opening edge of the cap. This bracket presents two holes in preselected positions and in the closure plate two counterbored sockets are formed in corresponding positions. Each socket presents a through hole in the bottom thereof wherein a screw is fitted.

In this manner the closure plate can be assembled and disassembled from the cap in a very simple way for an easy access to the hearing aid component parts received therein, both upon manufacturing of the hearing aid and during the life thereof for maintenance and repair purposes.

According to an alternative embodiment of the invention the bracket can be omitted and replaced by two threaded bushes welded or otherwise fixed to the opening edge at switable positions to receive the fixing screws.

According to a further feature of the construction of the invention, the hearing aid, and more a precisely the closure plate thereof is provided with gripping member that protrudes outwardly therefrom only when it is necessary and without providing further members in respect to the hearing aids of the prior art, which members would unduly complicate the hearing aid contruction.

According to this feature, the circular cover closing the battery seat in the closure plate is so shaped as to be used as a gripping member for the user's fingers. More particularly this cover is hinged tangentially to the edge thereof as to be able to rotate about a axis which substantially lies in the plane of the closure plate between a lowered closed position and a raised open position, the two positions being angularly spaced apart of about 90°.

Accordingly in the open position, the cover of the invention constitutes a gripping member for an easy introduction and removal of the hearing aid from the user's ear.

The invention will be now more particularly disclosed with reference to the acompanying drawings wherein.

Figure 1:
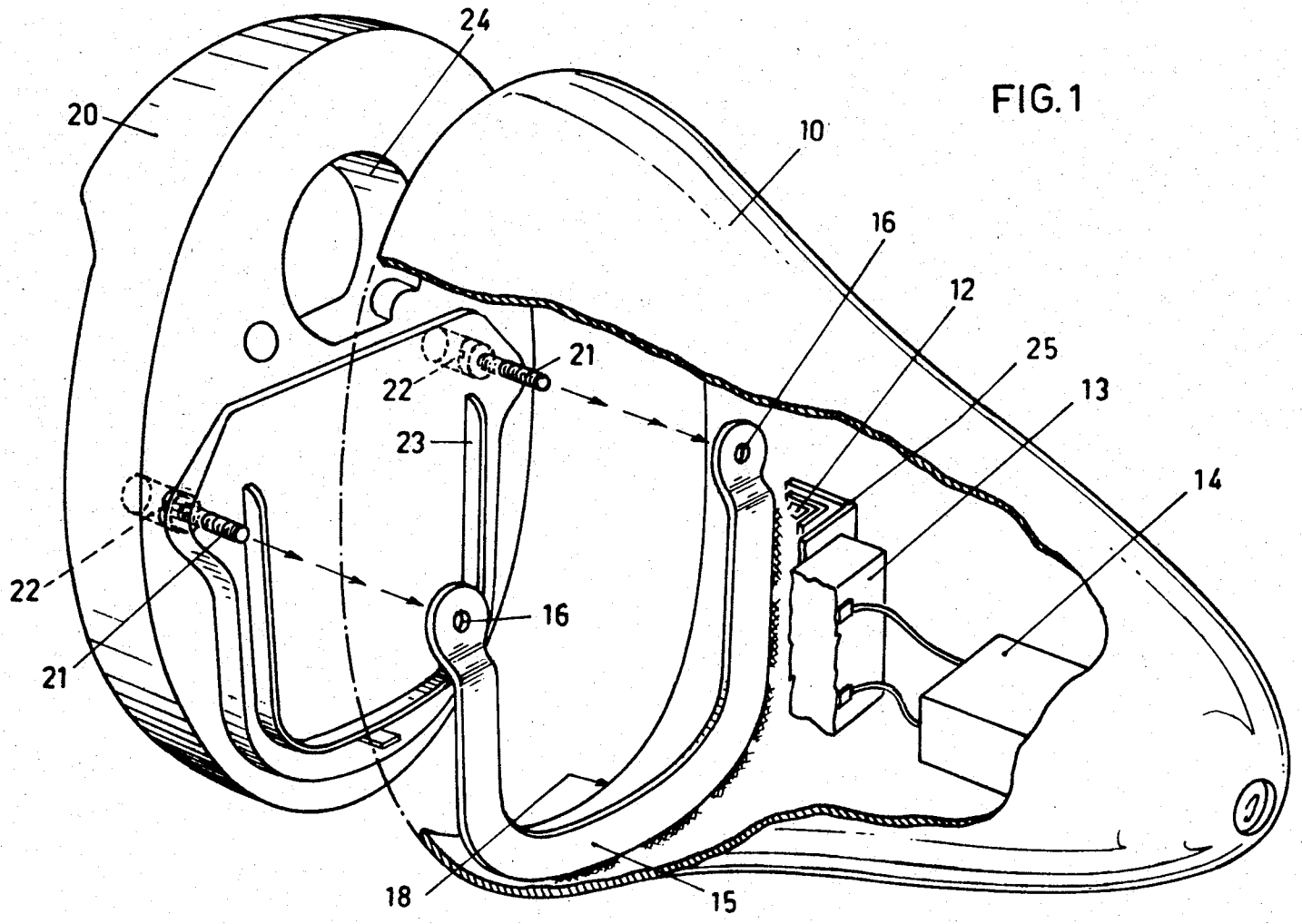
FIG. 1 is an exploded, much enlarged perspective view with the outer cap partiallly cut away to show the inside thereof, of a hearing aid embodying the joining system for the closure plate of the invention.

With reference to FIG. 1, the hearing aid of the type set-forth comprises a housing or outer cap 10 of anatomic, generally frusto-conical shape, having a circular base, and a circular access opening.

Inside cap 10 are received the electric and electronic component parts of the hearing aid, namely, a microphone 12, an amplifier 13 and an eletroacoustic transducer 14.

Figure 4:
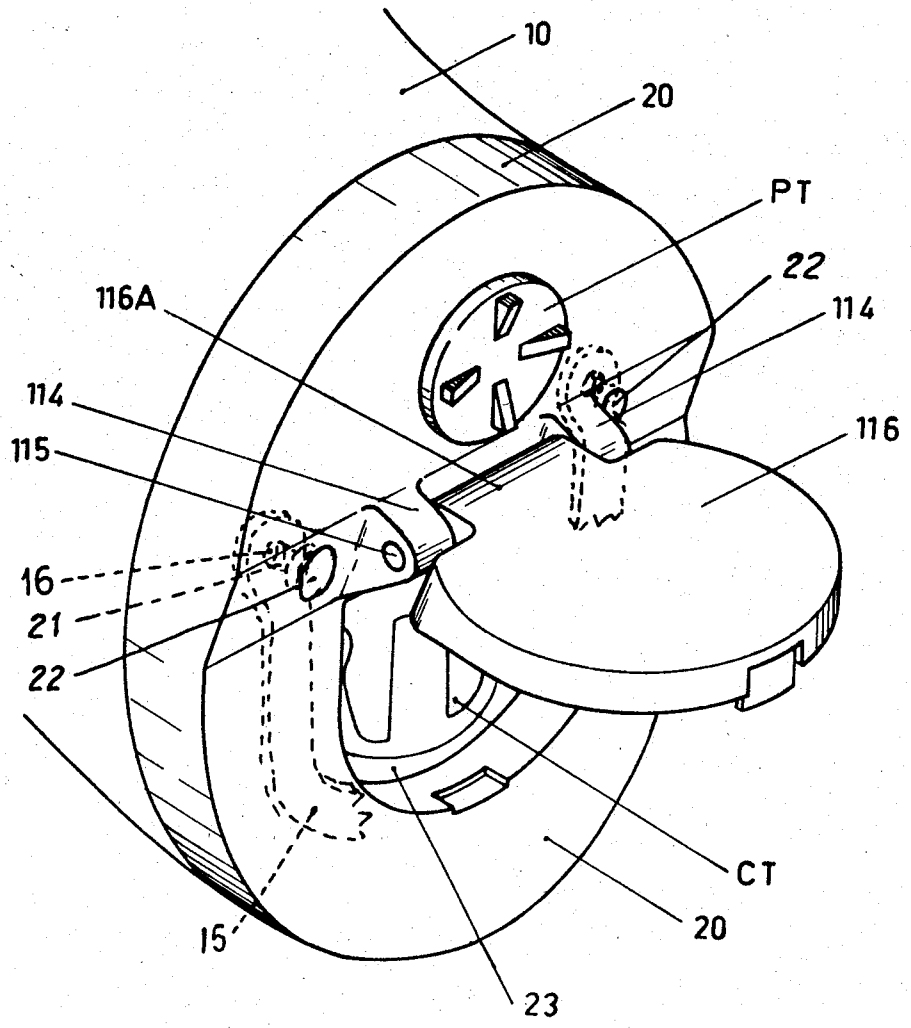
FIG. 4 is a similar view of the improved closure plate with the battery seat cover in the open position.

Cap 10 is closed by a closure plate 20. Closure plate 20 has a substantially circular shape, is made from a suitable plastic material and generally is provided with a battery and a potentiometer—switch device (not shown) received in suitable seats formed in the plate thickness, referred to by numeral references 23 and 24, respectively. (FIGS. 1, 2 and 4)

Figure 2:
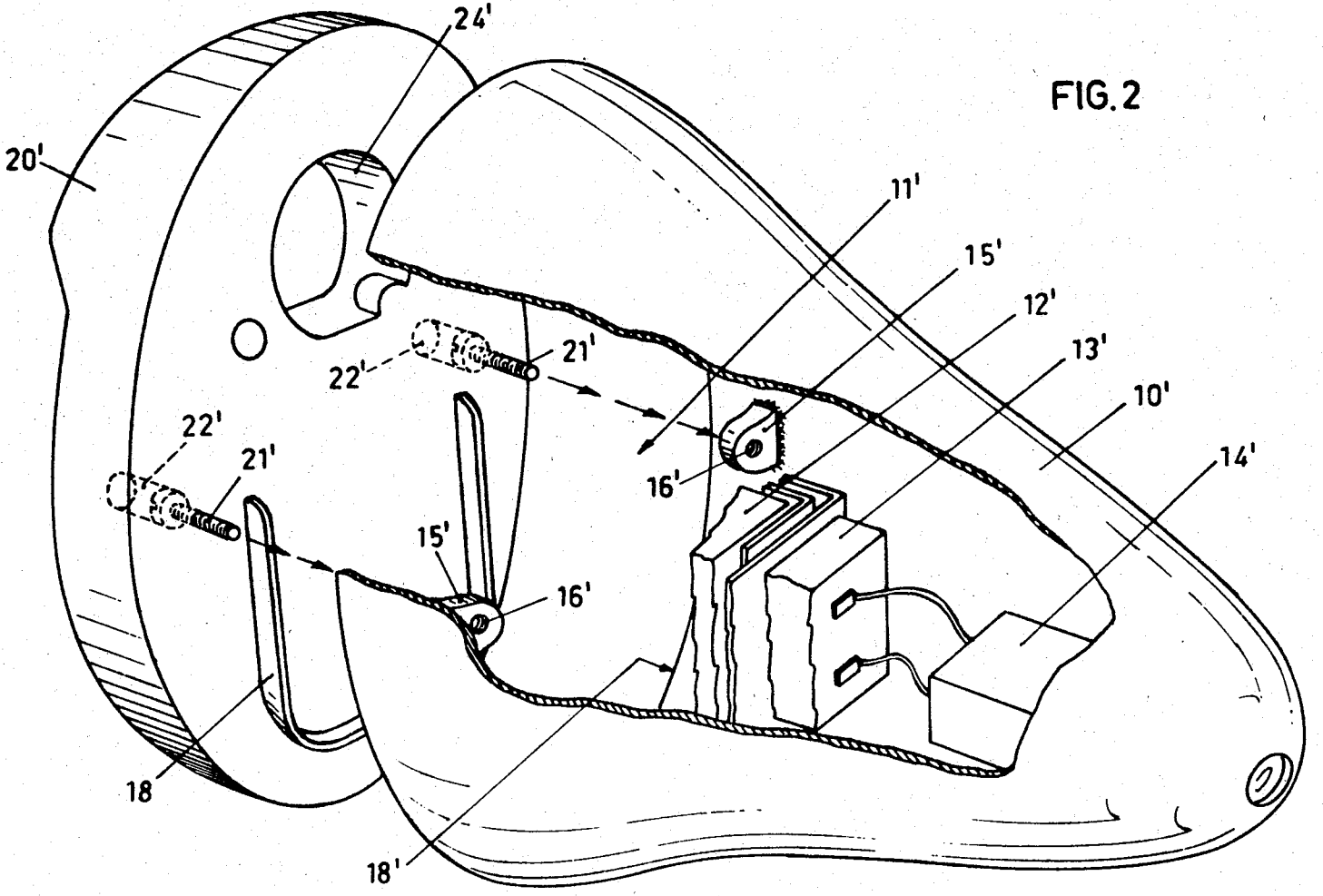
FIG. 2 is a similar view showing an alternative embodiment of the joining system for the closure plate.

Microphone 12, amplifier 13 and electroacoustic transducer 14 (all cut away for clearness sake) are mounted on plate 20 through a suitable mounting frame, that is partially cut away and referred to by reference 23 in FIGS. 1 and 2, and are received inside cap 10 when the hearing aid is assembled.

In such a hearing aid, according to the invention a horse-shoe shaped bracket 15 is used to detachably join plate 20 to cap 10.

Bracket 15 is made from a suitable thin metallic sheet and is provided with tow spaced apart holes 16, and is welded or otherwise suitably attached to the cap wall adjacent to the opening edge 18.

Two counterbored sockets 22 are formed in closure plate 20 at spaced positions corresponding to holes 16. Each socket 22 has a through hole in the bottom thereof and receives a screw 21 protruding from the lower face of plate 20. Accordingly each screw 21 can be screwed in corresponding hole 16 of bracket 15 thus joining closure plate 20 to cap 10.

Closure plate 20 can be removed by unscrewing screws 21, thus allowing an easy access to the component parts mounted on plate 20, for maintenance and repair purposes.

An alternative embodiment of the jointing system is shown in FIG. 2 wherein similar parts have been referred to by similar numerals provided with an apex.

In this embodiment bracket 15 is replaced by two bushes 15' welded, glued or otherwise suitably fixed adjacent to edge 18' of opening 11'.

Bushes 15' are preferably of a suitable metal and present a threaded hole 16'. Of course the positions of bushes 15' must correspond to the positions of sockets 22' on closure plate 20 so that screws 21 can be threadingly received in holes 19'.

Figure 3:
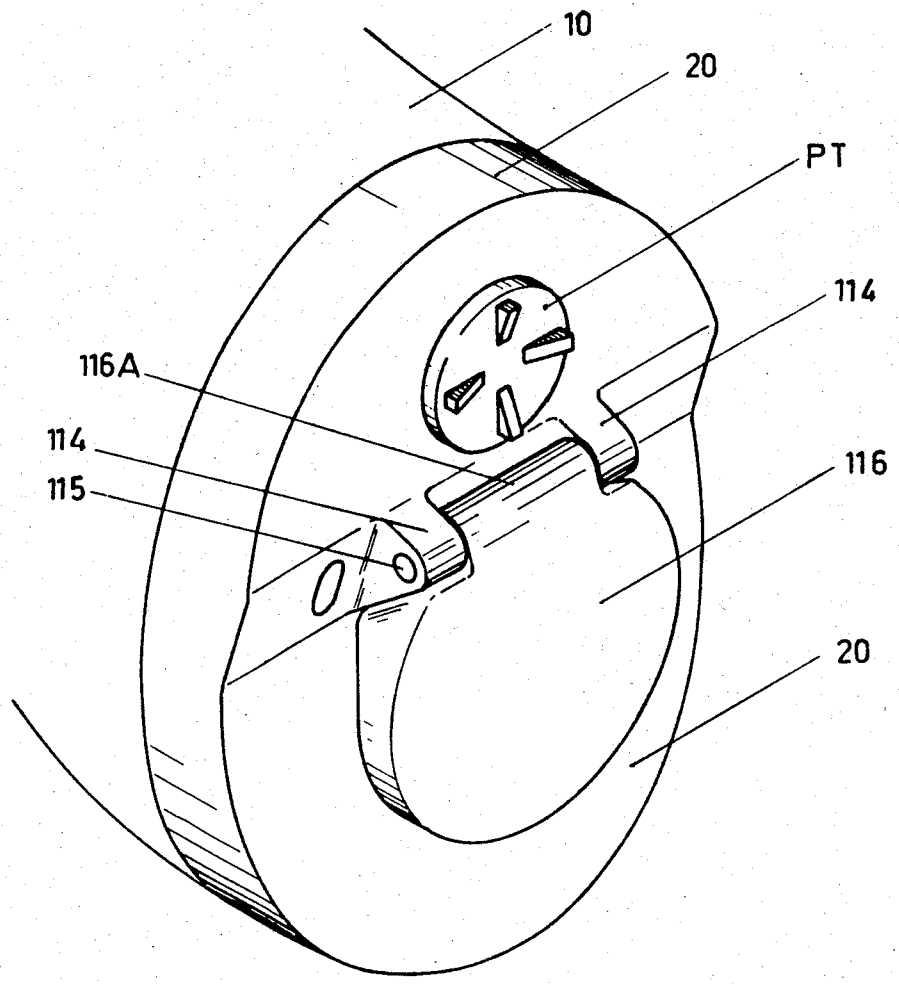
FIG. 3 is a fragmentary perspective view of a hearing aid provided with the improved closure plate of the invention with the battery seat cover in the closed position.

FIG. 3 and 4 show the closre plate for the battery seat provided with the improved cover of the invention.

As shown, closure plate 20 is provided with a potentiometer PT and a seat 23 for a battery (not shown) that powers the hearing aid through the metal contact CT provided in the seat bottom.

Integral with the upper face of closure plate 20, between potentiometer-switch device PT and battery seat 23, are two bushes 114 receiving the rotating pin integral with a tab 116A of cover 116 for seat 23.

Cover 116 has substantially a circular shape with a rectilinear base from which tab 116A protrudes.

Due to said construction, cover 116 can rotate about the axis of pin 115 between a closed position (FIG.3) and an open position (FIG. 4).

In the open positions cover 116 can be easily gripped by the user's fingers both during the introduction of the hearing aid in the user's external auditory meatus and removal therefrom.

Cover 116 is preferably biased by an overcenter snap spring (not shown) both in the closed and open position.

It will be appreciated that the invention is not limited to the parts and combination thereof disclosed and illustrated and that modifications and changes can be made without departing from the scope and concepts thereof.

I claim:

1. A hearing aid of the type intended to be completely received in the external auditory meatus of the user and comprising a housing of frustroconical shape having an opening; a closure plate for said opening; a battery seat in said closure plate; a combined battery seat cover and grip means mounted on the outer face of the closure plate so that it is moveable between a closed position and an open and easily gripped position; wherein the cover and grip means covers the battery seat in the closed position, and wherein the cover and grip means extends outward from the closure plate to allow the planar faces of said cover and grip means to be securely gripped between the user's fingertips in the open and easily gripped position, whereby the hearing aid can be positioned and easily removed from the user's ear when the hearing aid is in the open and easily gripped position.

2. A hearing aid as claimed in claim 1 wherein the seat cover and grip means is pivotable about an axis which is parallel to the outer face of the closure plate.

* * * * *